United States Patent [19]

Kitada

[11] Patent Number: 4,510,643

[45] Date of Patent: Apr. 16, 1985

[54] VACUUM FLOOR POLISHER

[76] Inventor: Hisao Kitada, 3115 Oaza Kitano, Tokorozawa-shi, Saitama-ken, Japan

[21] Appl. No.: 490,847

[22] Filed: May 2, 1983

[30] Foreign Application Priority Data

Jun. 1, 1982 [JP] Japan ..... 57-93584

[51] Int. Cl.[3] ..... A47L 11/03

[52] U.S. Cl. ..... 15/320; 15/50 R

[58] Field of Search ..... 15/320, 385, 401, 50 R, 15/49 R, 4; 134/7

[56] References Cited

U.S. PATENT DOCUMENTS

| | | | |
|---|---|---|---|
| 1,410,913 | 3/1922 | Gray | 134/7 |
| 1,463,583 | 7/1923 | Holleran | 15/320 |
| 1,808,656 | 6/1931 | Hartman | 15/50 R |
| 2,250,177 | 7/1941 | Boccasile | 15/320 |
| 2,680,260 | 6/1954 | Danielsson et al. | 15/320 X |
| 2,683,885 | 7/1954 | Johnson | 134/7 X |
| 2,893,037 | 7/1959 | Strong | 15/50 R X |
| 3,375,540 | 4/1968 | Hyde | 15/401 X |

*Primary Examiner*—Chris K. Moore

*Attorney, Agent, or Firm*—Spencer & Frank

[57] ABSTRACT

A vacuum floor polisher wherein polishing material is fed by gravity from a tank and dropped onto the floor through the center of a polishing disc which rotates the polishing material on the floor. The floor is polished by the rotating polishing disc and with the polishing material fed, which after polishing is sucked up by the stream of air and recovered into the upper tank. By incorporating adequate cleaner in the polishing material, the floor is polished and the dirt removed by the rotating disc and the polishing material. The dirt adheres to the polishing material. By mixing wax with the polishing material, the waxing is carried out together with the polishing step.

5 Claims, 6 Drawing Figures

VACUUM FLOOR POLISHER

BACKGROUND OF THE INVENTION

The present invention relates to a vacuum floor polisher in which used polishing or cleaning material may be recovered.

For cleaning or polishing floors of buildings, stations, schools, factories, hospitals, stores, hotels, etc., there have been used vacuum floor polishers whose brushes are rotated by electric motors.

In order to remove dirt and stains from the floor surface, a cleaning substance or polishing material, such as sawdust, pieces of wetted paper, fine plastic chips, etc., is scattered on the floor before the floor is polished by the rotating brush. Alternatively such material is supplied while the brush is rotated. In such a case, the polishing material containing dirt and dust must be taken away and cleaned before the next waxing process is carried out. In other words, separate polishing, cleaning and waxing steps are required and the entire process take considerable time and effort.

The objective of this invention is to provide a floor polisher which can deal with the above-mentioned three process steps as a single operation of the machine.

SUMMARY OF THE INVENTION

In operating the vacuum floor polisher of this invention, the polishing material is fed by gravity from a tank and dropped onto the floor through the center of a polishing disc which rotates the polishing material on the floor. The floor is polished by the rotating polishing disc as the polishing material fed is fed on the floor. Simultaneously, the polishing material containing dirt is sucked up by the stream of air and recovered in the upper tank. By incorporating adequate cleaner in the polishing material, the floor is polished and the dirt on the floor surface removed by the rotating disc and the polishing material to which the cleaner is added. Simultaneously, the dirt adheres to the polishing material, which is recovered in the tank to finish polishing the floor and take away the polishing material. By mixing wax with the polishing material, waxing is also carried out together with the polishing process. Thus, the work of polishing off the dirt removing and cleaning the polishing material and the dirt, and waxing may be completed by a single and continuous operation.

DESCRIPTION OF THE PREFERRED EMBODIMENTS

Figure 2:
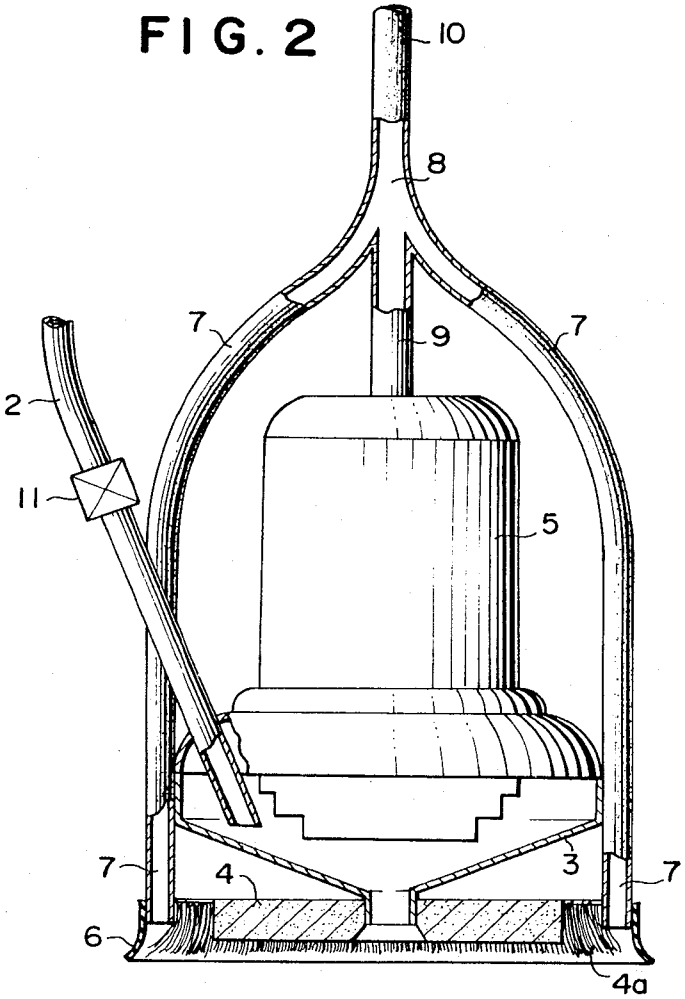
FIG. 2 is a side view, partially in section, of the embodiment of FIG. 1.
Figure 1:
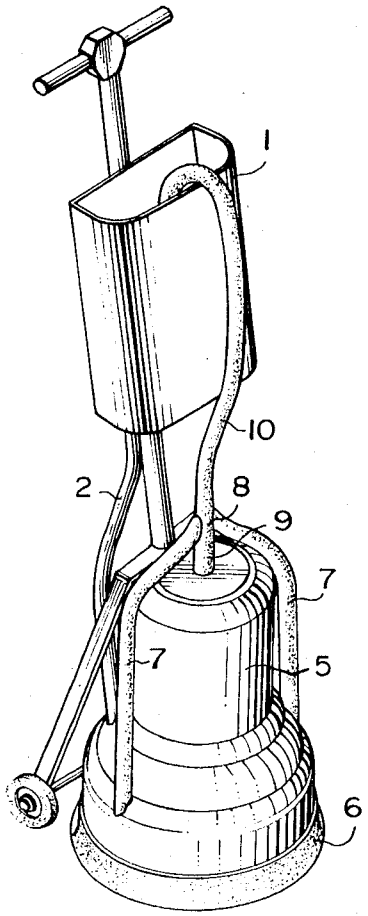
FIG. 1 is a perspective view of an embodiment of a vacuum floor polisher according to the present invention.
Figure 3:
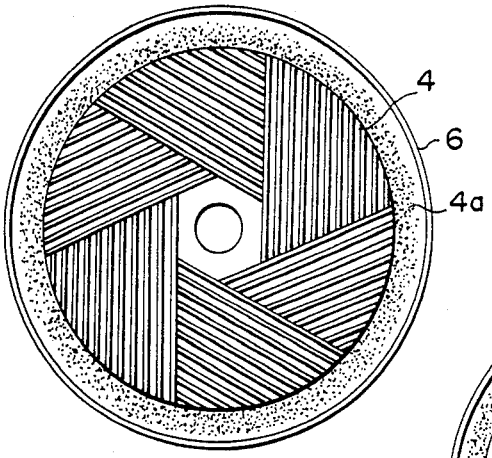
FIG. 3 is a bottom view of the embodiment shown in FIGS. 1 and 2.
Figure 4:
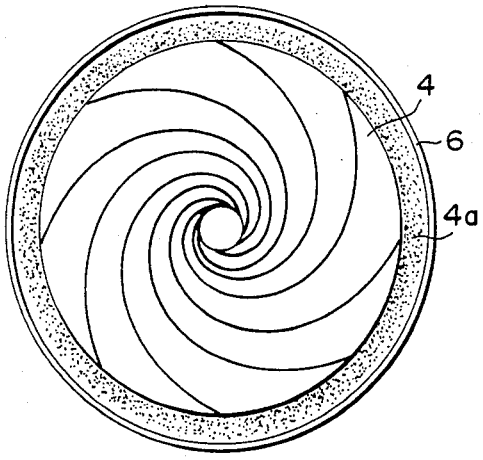
FIG. 4 is a bottom view of the polishing disc showing spiral grooves.
Figure 5:
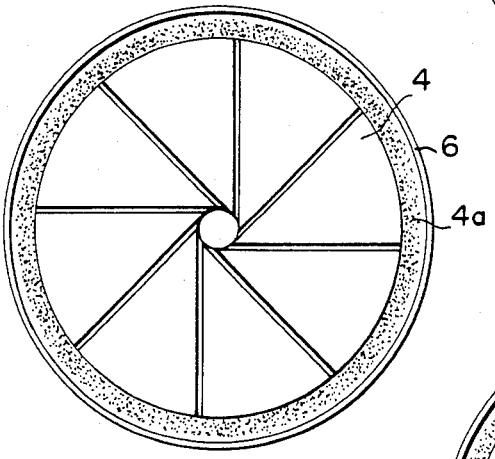
FIG. 5 is a bottom view of the polishing disc showing pseudo-spiral straight grooves.
Figure 6:
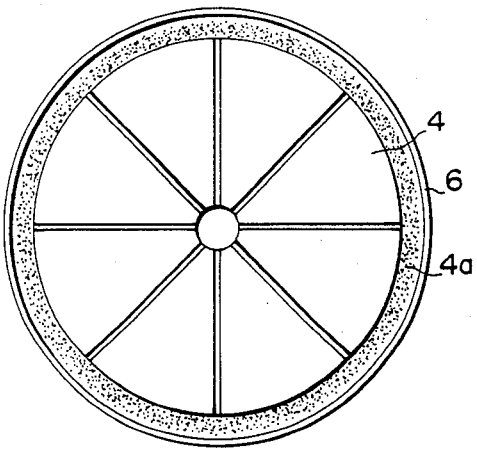
FIG. 6 shows radial grooves.

In FIGS. 1 and 2, the numeral 1 denotes a tank for holding polishing material such as sawdust, pieces of wetted paper, fine plastic chips, etc. Adequate wax is added to the polishing material in this embodiment. The numeral 2 denotes a downward conduit for passing the polishing material therethrough, and the polishing material is guided by the conduit 2 into a hopper 3. The hopper 3 further feeds the polishing material through the center of a rotary polishing disc 4. At the outer periphery of the polishing disc 4 there is provided a brush 4*a*. The polishing material deposited into the tank 1 is fed by gravity through the conduit 2, the hopper 3, the center of the rotary polishing disc 4 on to the floor. The polishing disc 4 is rotated by an electric motor 5 on the floor, in contact with the floor. Consequently, the polishing material is rotated with the disc 4 between the disc and the floor and guided in the outward direction of the disc 4 by the centrifugal force of the rotating disc 4 through grooves provided in the bottom of the disc 4 which contact the floor. A bottom view of the disc 4 provided with grooves is shown in FIG. 3, and modified forms of the bottom face of the polishing disc are further shown in FIGS. 4–6. FIG. 4 shows spiral grooves, FIG. 5 pseudo-spiral straight grooves and FIG. 6 shows radial grooves.

The polishing material passes between the outer brush 4*a* and the floor because of the air flow at a negative pressure and the centrifugal force. At this time, polishing of the floor removing and sucking of dirt from the floor takes place. Simultaneously, waxing is also completed by the waxes already added to the polishing material. The polishing material thus fed to the outer periphery of the brush 4*a* is kept from further outward movement by a screening skirt 6 provided at the further outer side of the brush 4*a*. The skirt 6 may be in the form of a screen or an extremely dense brush, if it only can obstruct the movement of the polishing material. The polishing material brought between the inner edge of the skirt 6 and the brush 4*a* is sucked into suction pipes 7 up to an upper portion 8 of the pipes 7 by the strong air flow at negative pressure. The strong air flow in the pipes 7 is generated by the flow of the high pressure air injected from a high pressure air pipe 9 to the upper portion 8 of the pipes 7, and operates on the principle of an atomizer. The polishing material reaching the upper portion 8 is then fed by the flow of high pressure air injected by the high pressure pipe 9 and recovered into the tank 1 through a high pressure conduit 10. The high pressure air may be generated by the cooling air from a cooling fan for the motor 5. Alternatively, the air may be generated by a separately provided blower, compressor or other means.

As above-mentioned, recycling of the polishing material may occur repeatedly, and also, polishing, cleaning and waxing of the floor occur continuously.

The polishing material including dirt and dust is brought to the tank with the high pressure air and is separated there from the high pressure air by a filtering screen. Or, the speed of the high pressure air is lowered to drop the polishing material by the gravity thereof. Or, the stream of the high speed air is changed to a spiral stream for separation by centrifugal force.

An on-off valve 11 or throttle valve 11 is provided on the conduit 2 and the feeding of the polishing material may be stopped or lessened by the operation of the valve 11. Thus the volume of polishing material can be controlled, and the unnecessary supply thereof may be stopped when the polishing is finished or at a break of the work. The shutter 11 may be provided at a discharge port of the hopper 3.

The recovered polishing material may be thrown away or if it may be used again, it is used for the next operation. Thus, repeated use of the polishing material is possible.

Many modifications are possible on the above-mentioned embodiments of this invention. Some modified forms for the grooves provided at the bottom of the polishing disc 4 are explained with reference to FIGS. 4, 5 and 6. The disc 4 itself may be constructed with a brush.

What is claimed is:

1. A vacuum floor polisher comprising:

(a) a rotary polishing disc which rotates polishing material and polishes the floor, the bottom of said rotary polishing disc being provided with grooves for guiding the polishing material outwardly;

(b) a tank for the polishing material;

(c) a first conduit which guides the polishing material fed from the tank into the center of the rotary polishing disc;

(d) a skirt provided at the periphery of the rotary polishing disc forming an enclosure about said disc, said skirt preventing the polishing material from being spread outwardly beyond the periphery of said disc by the rotation of said disc; and (e) a second conduit extending from said enclosure to said tank; and means cooperating with said second conduit to create a suction flow into said second conduit in said enclosure thereby introducing atmospheric air under the inner edge of the skirt and causing the polishing material to be recovered in the tank.

2. A vacuum floor polisher according to claim 1, wherein the polishing material is made of sawdust.

3. A vacuum floor polisher according to claim 1, wherein a brush is provided around the polishing disc which polishes and cleans the floor by rotating the polishing material.

4. A vacuum floor polisher according to claim 4, wherein the grooves are spiral.

5. A vacuum floor polisher according to claim 1, wherein the grooves are radial.

* * * * *